US008216325B2

(12) United States Patent
Upadhyay

(10) Patent No.: US 8,216,325 B2
(45) Date of Patent: Jul. 10, 2012

(54) HIGH POROSITY SUPERABRASIVE RESIN PRODUCTS AND METHOD OF MANUFACTURE

(75) Inventor: Rachana D. Upadhyay, Shrewsbury, MA (US)

(73) Assignees: Saint-Gobain Abrasives, Inc., Worcester, MA (US); Saint-Gobain Abrasifs, Conflans-Sainte-Honorine (FR)

( * ) Notice: Subject to any disclaimer, the term of this patent is extended or adjusted under 35 U.S.C. 154(b) by 328 days.

(21) Appl. No.: 12/387,792

(22) Filed: May 7, 2009

(65) Prior Publication Data

US 2010/0018126 A1 Jan. 28, 2010

Related U.S. Application Data

(60) Provisional application No. 61/132,867, filed on Jun. 23, 2008.

(51) Int. Cl.
*B24D 3/00* (2006.01)
*B24D 3/32* (2006.01)

(52) U.S. Cl. ..... 51/296; 51/298; 51/307; 51/309

(58) Field of Classification Search ..... 51/296, 51/298, 307, 309
See application file for complete search history.

(56) References Cited

U.S. PATENT DOCUMENTS

| | | | | |
|---|---|---|---|---|
| 6,770,107 | B2 * | 8/2004 | Teutsch et al. | 51/298 |
| 2004/0137834 | A1 * | 7/2004 | Webb et al. | 451/526 |
| 2006/0135045 | A1 | 6/2006 | Bian et al. | |
| 2007/0028525 | A1 | 2/2007 | Woo et al. | |
| 2007/0060023 | A1 * | 3/2007 | Jeong | 451/5 |
| 2007/0261690 | A1 | 11/2007 | Jentgens | |

* cited by examiner

*Primary Examiner* — Elizabeth Wood
(74) *Attorney, Agent, or Firm* — Abel Law Group, LLP; Joseph P. Sullivan

(57) ABSTRACT

A superabrasive product, such as a superabrasive tool, includes a superabrasive grain component and a porous continuous phase that includes a thermoplastic polymer component in which the superabrasive grain component is distributed. A superabrasive product precursor to the superabrasive product includes a superabrasive grain component, a bond component and a polymer blowing agent of encapsulated gas. A method of forming a superabrasive product includes combining a superabrasive, a bond component and a polymer blowing agent of encapsulated gas to form, for example, a superabrasive product precursor. The combined superabrasive, bond component and polymer blowing agent of encapsulated gas are heated to a temperature and for a period of time that causes release of at least a portion of the gas from encapsulation within the blowing agent.

20 Claims, 3 Drawing Sheets

HIGH POROSITY SUPERABRASIVE RESIN PRODUCTS AND METHOD OF MANUFACTURE

CROSS REFERENCE TO RELATED APPLICATIONS

This application claims priority to U.S. Provisional Patent Application Ser. No. 61/132,867, filed Jun. 23, 2008, incorporated herein by reference.

BACKGROUND OF THE INVENTION

With the global trend of miniaturization, electronic devices are becoming smaller. For semiconductor devices required to operate at high power levels, wafer thinning improves the ability to dissipate heat. As final thickness is decreased, the wafer progressively becomes weaker to support its own weight and to resist the stresses generated by post backgrinding processes. Thus, it is important to reduce the damages caused by backgrinding and improve its quality.

The original thickness of silicon wafers during chip fabrication is 725-680 μm for 8 inch wafers. In order to obtain faster and smaller electronic devices, the wafers need to be thinned before dicing into individual chips. The grinding process consists of two steps. First, a coarse abrasive wheel grinds the surface to around 270-280 μm, but leaves behind a damaged Si surface, the (backside) surface of the Si wafer. Then, a fine abrasive wheel smoothens part of the damaged surface and grinds the wafer to 250 μm. Wafers with thicknesses down to 100-50 μm are virtually a standard requirement for some IC chip applications. For a long time now the most common thickness of about 180 μm in smart cards is being replaced by the thinner and thinner IC chips.

Backgrinding with a metal-bonded superabrasive wheel generally is not advisable due to contamination issues. Circuitries on the front side of the wafer can cause metal interference from the wheels. Therefore, metal-bonded superabrasive wheels should not be employed for backgrinding application. On the other hand, glass bonded superabrasive wheels with the same size grain will induce more subsurface damage and will adversely affect the surface roughness of the finished silicon wafer.

In such situations, resin bonded superabrasive products are preferred. Due to the compliant nature of the bond it will improve surface roughness and induce less subsurface damage. The bond typically will not interfere with the circuitries. Thus, Resin bonded products are best suited for backgrinding applications.

Moreover, superabrasive tools typically must have an open-porous structure in order to minimize accumulation of swarf generated during grinding, and to cool, or at least maintain, a consistent surface temperature at the work piece to which the grinding tool is being applied. Manufacturing a tool that has sufficient strength and wear characteristics, and which also has sufficient porosity, is a persistent challenge, particularly in view of the ever-increasing number of applications to which such tools are being put.

Therefore, a need exists for grinding tools capable of roughing or finishing hard work pieces, as well as for methods of manufacturing such tools, that reduce or eliminate the above-mentioned problems.

SUMMARY OF THE INVENTION

The invention generally relates to a superabrasive product, a superabrasive product precursor to a superabrasive product, and to a method of making a superabrasive product.

The superabrasive product includes a superabrasive grain component and a porous continuous phase that includes a thermoplastic polymer component, wherein the superabrasive grain component is distributed in the porous continuous phase. The superabrasive grain component can be, for example, diamond, cubic boron nitride, zirconia, or aluminum oxide. The continuous phase can include a thermoset resin component, such as phenol-formaldehyde. The thermoplastic polymer component can include, for example, polyacrylonitrile and polyvinyledene. Preferably, a superabrasive product has an open-porous structure, whereby a substantial portion of the pores of the product are interconnected and in fluid communication with a surface of the superabrasive product.

In another embodiment, the invention is a superabrasive product precursor to a superabrasive product. The superabrasive product precursor includes a superabrasive grain component, a bond component and a polymer blowing agent, wherein the polymer blowing agent encapsulates gas. A preferred superabrasive grain component of the superabrasive product precursor is diamond. The bond component is, for example, a thermoset, such as phenol-formaldehyde. The polymer blowing agent, includes discrete particles, at least a portion of the particles having a shell that encapsulates gas. Preferably, the thermoplastic polymer is a combination of polyacrylonitrile and polyvinyledene chloride. Typically, the encapsulated gas is at least one of isobutane and isopentane.

In still another embodiment, the invention is a method for forming a superabrasive product. The method includes combining a superabrasive, a bond component and a polymer blowing agent of encapsulated gas. The combined superabrasive, bond component and polymer blowing agent are heated to a temperature and for a period of time that causes release of at least a portion of the gas from encapsulation within the blowing agent. Typically, the superabrasive is diamond, the bond includes a thermoset, such as phenol-formaldehyde, and a blowing agent of encapsulated gas includes a thermoplastic shell of at least polyacrylonitrile and polyvinyledene chloride, encapsulating a gas of at least one of isobutane and isopentane.

This invention has many advantages. For example, the superabrasive product of the invention exhibits strength characteristics, characteristic of a blend of thermoset and thermoplastic polymers, such as hardness, often in excess of superabrasive tools that employ a vitreous bond, but without the brittleness often associated with tools employing a vitreous bond. Further, the superabrasive products of the invention can bind superabrasive grain components, such as diamonds, very effectively, enabling fabrication tools having a wider range of grain component particle size. In addition, the tools of the invention have a relatively high porosity, thereby enabling the tools to be cooled more effectively. As a consequence, grinding of a work piece can be better controlled and wear of the grinding tool is significantly reduced. The superabrasive tools of the invention can be fabricated relatively easily, at lower temperatures, for shorter cycles and under more environmentally friendly conditions, than is common among methods required to fabricate other types of superabrasive tools, such as tools that employ a vitreous bond. The superabrasive tools on the invention can include fixed abrasive vertical (FAVS) spindle-type tools, wheels, discs, wheel segments, stones and hones. In one embodiment, the superabrasive product of the invention can be employed in fixed abrasive vertical spindle (FAVS)-type applications.

DETAILED DESCRIPTION OF THE INVENTION

Figure 1:
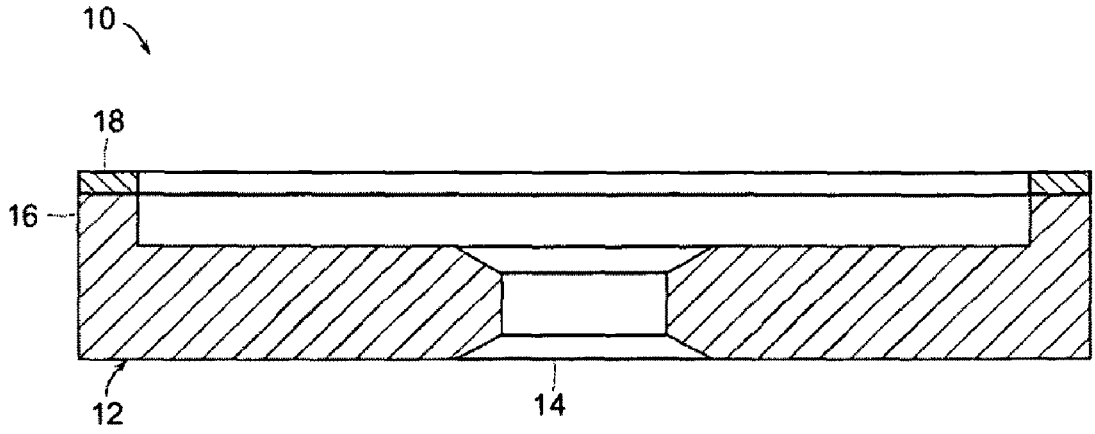
FIG. 1 is a cross-section of one embodiment of a tool that employs a vitrified superabrasive product of the invention.

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

The invention is generally related to superabrasive products, including superabrasive tools. The invention is also directed to superabrasive product precursors that are precursors to the superabrasive products and to methods of making superabrasive products of the invention.

The superabrasive product of the invention includes a superabrasive grain component and a porous continuous phase. The continuous phase includes a thermoplastic polymer component in which the superabrasive grain component is distributed. Generally, the superabrasive tool is a bonded abrasive tool, as opposed to, for example, a coated abrasive tool.

"Superabrasive," as that term is employed herein, means abrasives having hardness, as measured on the Knoop Hardness Scale of at least that of carbon boron nitride (CBN), i.e., a $K_{100}$ of at least 4,700. In addition to cubic boron nitride, other examples of superabrasive materials include natural and synthetic diamond, zirconia and aluminum oxide. Suitable diamond or cubic boron nitride materials can be crystal or polycrystalline. Preferably, the superabrasive material is diamond.

The superabrasive material is in the form of grain, also known as "grit." The superabrasive grain component of the invention can be obtained commercially or can be custom-produced. Generally, the superabrasive employed in the present invention has an average particle size in a range of between about 0.25 microns and 50 microns. Preferably, the particle sizes are in a range of between about 0.5 microns and 30 microns. In particular embodiments, the average particle size of the grit can be in a range of between about 0.5 microns and 1 micron, between about 3 microns and about 6 microns, or between about 20 microns and 25 microns.

In one embodiment, the superabrasive grain component is present in an amount of at least 35% by volume of the superabrasive tool. In another embodiment, the superabrasive grain component is present in an amount in a range of between about 3% and about 25% by volume of the superabrasive tool, more preferably between about 6% and about 20% by volume of the superabrasive tool. In still another embodiment, the ratio of superabrasive grain component to continuous phase of the superabrasive product is in a range of between about 4:96 and about 30:70 by volume, or more preferably in a range of between about 15:85 and about 22:78 by volume.

Porosity plays an important role in grinding. Porosity controls the contact area between the work piece and the composite microstructure. Porosity facilitates movement of coolant around the microstructure to keep the grinding surface temperature as low as possible. It is important to understand different structures created by using a plurality of different size pore inducers.

Wear resistant microstructure is created by using relatively large, e.g., 120-420 μm diameter physical blowing agents. This structure, generally, will yield good life as big pores will create fewer, but stronger bridges. This structure will draw more power during grinding but will allow good clearance of chip and better coolant flow. On the other hand, more of a self-dressing structure is created by using physical blowing agents between the sizes of 10-80 μm. This structure will create a higher number of smaller bridges which will wear faster but, will draw less power while grinding. A good balance of smaller and larger pore inducers produces a microstructure with good life, but drawing relatively little power during grinding.

The continuous phase of the superabrasive product includes a thermoset polymer component. Examples of suitable thermoset polymer components for use in the continuous phase of the superabrasive product of the invention include polyphenol-formaldehyde polyamide, polyimide and epoxy-modified phenol-formaldehyde. In a preferred embodiment, the thermoset polymer component is polyphenol-formaldehyde.

The continuous phase of the superabrasive product of invention also includes a thermoplastic polymer component. Examples of suitable thermoplastic polymer components include at least one member selected from the group consisting of polyacrylonitrile, polyvinyledene, polystyrene and polymethylmethacrylate (PMMA). Examples of preferable thermoplastic polymer components include polyacrylonitrile and polyvinyledene chloride. In a particularly preferred embodiment, the continuous phase of the superabrasive product includes a combination of polyacrylonitrile and polyvinyledene chloride. In one embodiment, the weight ratio of polyacrylonitrile and polyvinyledene chloride is in a range of between about 60:40 and about 98:2. In a particularly preferred embodiment, the ratio between polyacrylonitrile and polyvinyledene chloride is in a ratio of between about 50:50 and 90:10.

The volume ratio between thermoplastic polymer component and thermoset polymer component in the continuous phase typically is in a range of between about 80:15 and about 80:10. In a particularly preferred embodiment, the volume ratio between the thermoplastic polymer component and thermoset polymer component of the continuous phase is in a range of between about 70:25 and about 70:20. In another preferred embodiment, the volume ratio of thermoplastic to thermoset polymer in the continuous phase is in a range of between about 50:30 and about 50:40.

Other components of the superabrasive product can include, for example, inorganic fillers like silica, silica gel in a range of between about 0.5 volume percent and about 3 volume percent.

In another embodiment, the invention is a superabrasive product precursor to a superabrasive product. The superabrasive product precursor includes a superabrasive grain component, a bond component and a polymer blowing agent of encapsulated gas. The superabrasive grain component of the superabrasive product precursor is as described above with respect to the superabrasive product. The bond component typically is a thermoset resin component that will polymerize during conversion of the superabrasive product precursor to a superabrasive product. Examples of suitable bond components include those known in the art, such as phenol-formaldehyde, polyamide, polyimide, and epoxy-modified phenol-formaldehyde.

In one embodiment, the blowing agent includes discrete particles, at least a portion of the particles having a shell that encapsulates gas. Generally, at least a portion of the shells include a thermoplastic polymer. Examples of suitable plastic polymers include polyacrylonitrile, polyvinyledene, such as polyvinyledene chloride, polystyrene, nylon, polymethylmethacrylate (PMMA) and other polymers of methylmethacrylate. In one embodiment, the discrete particles are of at least two distinct types, wherein each type includes a different composition of thermoplastic shell. For example, in one embodiment, at least one type of discrete particle has a thermoplastic shell that substantially includes polyacrylonitrile. In another embodiment, at least one type of discrete particle has a thermoplastic shell that substantially includes polyvinyledene chloride. In still another embodiment, at least one type of discrete particle of the blowing agent has a thermoplastic shell that substantially includes polyacrylonitrile and another type of discrete particle of the blowing agent has a thermoplastic shell that substantially includes polyvinyledene chloride.

Typically, polymeric spheres that encapsulate gas, such as those that include at least one of polyacrylonitrile, polyvinyledene chloride, polystyrene, nylon and polymethylmethacrylate (PMMA), and other polymers of methylmethacrylate (MMA), and which encapsulate at least one of isobutane and isopentane, are available commercially in "expanded" and "unexpanded forms." "Expanded" versions of the spheres generally do not expand significantly during heating to a temperature that causes the polymeric shells of the spheres to rupture and release the encapsulated gas. "Unexpanded" versions, on the other hand, do expand during heating to temperatures that cause the polymeric shells to rupture. Either type of polymeric sphere is suitable for use in the present invention, although expanded polymeric spheres are preferred. Unless stated otherwise, reference to sizes of polymeric spheres herein are with respect to expanded spheres.

Often, suitable polymeric spheres that are commercially available are treated with calcium carbonate ($CaCO_3$) or silicon dioxide ($SiO_2$). Examples of suitable commercially available polymeric spheres include Expanded DE 40, DE 80 and 950 DET 120, all from Akzo Nobel. Other examples include Dualite E135-040D, E130-095D and E030, all from Henkel.

In another embodiment, the blowing agent of the superabrasive product precursor includes discrete particles of a shell that includes a copolymer polyacrylonitrile and polyvinyledene chloride. The ratio by weight of polyacrylonitrile to polyvinyledene chloride can be, for example, in a range of between about 40:60 and about 99:1. The average particle size of the blowing agent can be, for example, in a range of between about 10 microns and about 420 microns. In a specific embodiment, the average particle size of a blowing agent can be in a range of about 20 microns and 50 microns. In this embodiment, the weight ratio of polyacrylonitrile to polyvinyledene can be, for example, in a range of between about 40:60 and 60:40. Preferably, the weight ratio of polyacrylonitrile to polyvinyledene chloride in this embodiment is about 50:50.

In another embodiment, the average particle size of the blowing agent is in a range of between 85 microns and about 105 microns. In this embodiment, the weight ratio of polyacrylonitrile and polyvinyledene chloride preferably is in a range of between about 60:40 and about 80:20, with a particularly preferred ratio of about 70:30.

In still another embodiment, the average particle size of the blowing agent is greater than about 125 microns. In this embodiment, the weight ratio of polyacrylonitrile to polyvinyledene chloride preferably is in a range of between about 92:8 and about 98:2, with a particularly preferred ratio of about 95:5.

Examples of encapsulated gas of the discrete particles include at least one member selected from the group consisting of isobutane and isopentane. In the embodiment where suitable gases include at least one of isobutane and isopentane, the size of the discrete particles preferably is in a range of between about 8 microns and about 420 microns, and the wall thickness of the discrete particles encapsulating the gas preferably is in a range of between about 0.01 microns and about 0.08 microns.

The ratio of discrete bodies of the blowing agent to bond component in the superabrasive product precursor generally is in a range of between about 2:1 and about 30:35 by volume. In a specific embodiment, the volumetric ratio is 80:15, and in another embodiment the volumetric ratio is 70:25.

A method of forming a superabrasive product of the invention includes combining a superabrasive, a bond component and a polymer blowing agent of encapsulated gas.

The combined superabrasive, bond component and polymer blowing agent are heated to a temperature and for a period of time that causes at least a substantial portion of the encapsulated gas to be released from the superabrasive product precursor, whereby the superabrasive product formed has a porosity that is substantially an open porosity. "Open porosity," as defined herein, means that at least a portion, or a substantial portion, of the pores are in fluid communication with each other and with the surface of the superabrasive product. In one embodiment, where between about 70% and about 90% of the volume of the superabrasive product is occupied by pores, the product will be essentially all openly porous. Where the superabrasive product has porosity in a range of between about 40% and about 70%, then a portion of the pores will be closed and the remainder open. In still another embodiment, where porosity is in a range of between about 20% and about 40%, essentially all of the pores will be closed.

In one embodiment, the combined superabrasive, bond component and polymer blowing agent in the form of a superabrasive product precursor, is heated while the superabrasive product precursor is under a positive gauge pressure. Typically, the polymer blowing agent includes a thermoplastic polymer while the bond component includes a thermoset polymer, as described above with respect to the superabrasive product precursor of the invention. In one embodiment, the superabrasive product precursor is preheated to a first temperature of at least about 100° C. under pressure of at least two tons. The superabrasive product precursor is then heated from the first temperature to a second, soak temperature, of at least about 180° C. The superabrasive product precursor is then maintained at the soak temperature for at least about 15 minutes to thereby form the superabrasive particle. Typically, the superabrasive product precursor is heated to the first temperature, the second soak, temperature and maintained at the soak temperature while the superabrasive product precursor is in a mold, such as is known in the art.

After maintaining the superabrasive product precursor at the soak temperature for a period of time sufficient to form the superabrasive product, the superabrasive product is cooled from the soak temperature to a first reduced temperature, in a range of between about 100° C. and about 170° C. over a period of time in a range of between about 45 minutes and about 10 minutes. The superabrasive product typically is then cooled from the first reduced temperature to a second reduced temperature in a range of between about 30° C. and about 100° C. over a period of time in a range of between about 10 minutes and about 30 minutes.

Typically, the superabrasive product is cooled to the first reduced temperature by air cooling and then cooled from the first reduced temperature to the second reduced temperature by liquid cooling. The superabrasive article is then removed from the mold after being cooled to the second reduced temperature.

Typically, the vitrified superabrasive product of the invention as configured at least a component of a grinding tool. An example of a suitable grinding tool is a wheel.

In one preferred embodiment, the vitrified superabrasive product is a fixed abrasive vertical spindle (FAVS). An example of a FAVS, is shown in the Figure. As shown in the Figure, tool 10 is configured as a wheel having a base 12 about an axis 14. Raised perimeter 16 of wheel supports abrasive segment 18 about the perimeter of base 12. Abrasive segment is one embodiment of a vitrified superabrasive product of the invention. Typically, base will have a diameter in a range of between about six inches and about twelve inches, the height of the abrasive segment will be in a range of between about 2 millimeters (mm) and about 10 millimeters and have a width of between about 2 millimeters and about 4.5 millimeters Wheels, as described with reference to the Figure, are suitable for wafer grinding by rotation about their axis. In a direction counterclockwise to a rotation of the axis of a wafer being ground by the tool. Methods for grinding wafers by use of grinding wheels as generally described with respect to the Figure are known in the art.

The invention is further described by the following examples which are not intended to be limiting.

Exemplification

Resin composite microstructures were created using resin, superabrasive grit and pore inducer, or "blowing agent." Resin used in the microstructures was phenol-formaldehyde. The physical blowing agents were PAN and PVDC copolymer spheres from Dualite, of Henkel. The grains were diamond (3-6 microns).

To make the composite microstructures, material was weighed and mixed by stirring in a stainless steel bowl and then screened through 165 mesh screen three times (US standard size). It was then placed in a steel mold of a suitable design to yield test samples having the following dimensions: 5.020 inches×1.25 inches×0.300 inches. Each mixture was filled in the mold by spoon and was leveled in the mold using a leveling paddle. The completely loaded mold package was then transported to the electric press. Once the mold package was placed into the press, two tons of pressure was applied, ensuring that the top plate rode into the mold package evenly. After 2 tons of pressure had been applied, the temperature was raised to 100° C. The pressure applied to the mold package was compacted. The temperature of the mold package was raised to 180° C., and then soaked for 15 minutes. Once the soak cycle was complete, the press was allowed to cool down to 100° C. by air cooling, followed by water cooling to room temperature. The mold package was removed from the press and transported to the "stripping" arbor press setup. The mold package (top and bottom plates plus the band) was placed onto the stripping arbor, strip band. The plates of the mold and sample were removed and ready to use. The formed disc was post-baked at 180° C. for 10 hours.

Wheels were produced to three different specifications. The specifications are as follows:

TABLE I

| | Parts by Volume | | |
|---|---|---|---|
| | Dual 2 | Dual 3 | Dual 5 |
| Abrasive | 22.5 | 22.5 | 25 |
| Resin | 30 | 27.5 | 27.5 |

TABLE I-continued

| | Parts by Volume | | |
|---|---|---|---|
| | Dual 2 | Dual 3 | Dual 5 |
| (μm) 98:2 (PAN:PVDC) | 28.5 | 30 | 28.5 |
| 85-105 (μm) 70:30 (PAN:PVDC) | 9.5 | 10 | 9.5 |
| 30:50 (μm) 50:00 (PAN:PVDC) | 9.5 | 10 | 9.5 |

They were then tested using a Strasbaugh backgrinding 7AF machine. The wheels were dressed using an ultra-fine dressing pad. The wheels were used to grind 8 inch silicon wafers. The silicon wafers were rough-ground with a rough wheel followed by a fine wheel.

The wheel performance was compared with the grinding forces and the life of the current SG wheel in market. The following Table 11 and the graphs of FIGS. 2 and 3 represent the grinding data.

TABLE II

| Specifications | Grinding forces in pounds |
|---|---|
| STD - prior art (BXL 6550) | 24-28 |
| Dual 2 | 16-20 |
| Dual 3 | 20-23 |
| Dual 5 | 17-20 |

Figure 2:
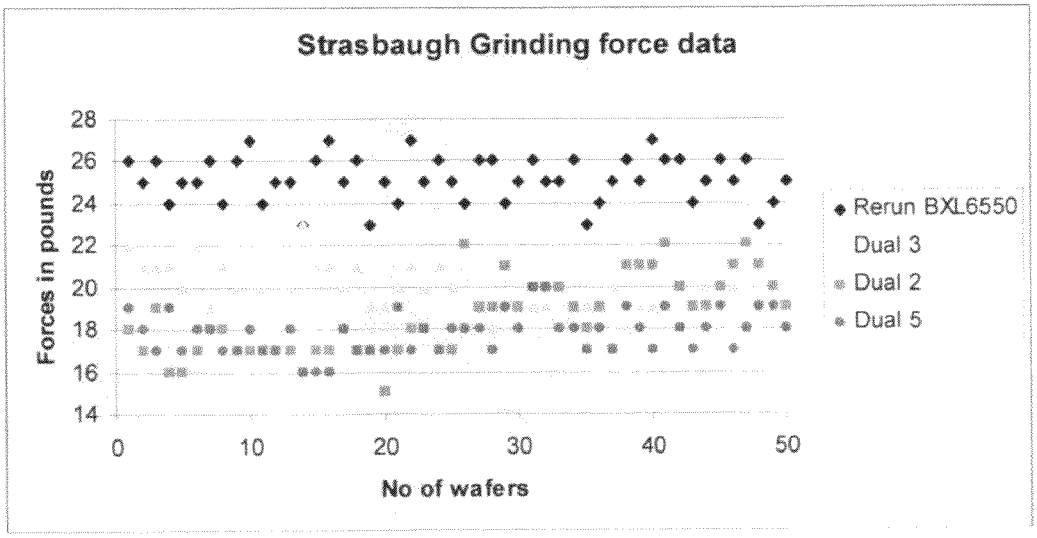
FIG. 2 is a graphical representation of comparative performance data.
Figure 3:
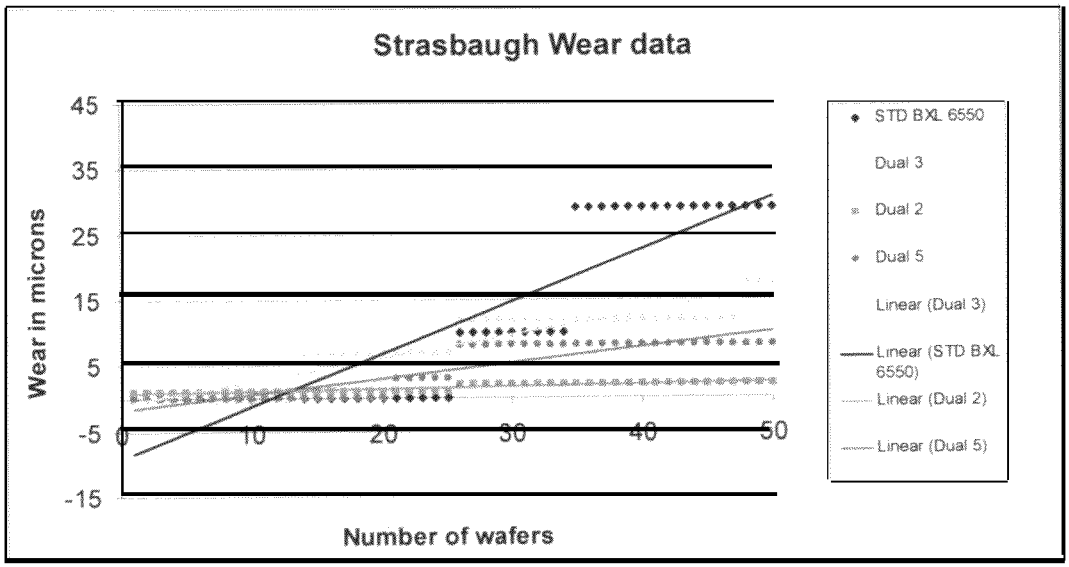
FIG. 3 is a graphical representation of comparative performance data.

The above Table II and FIG. 2 compare the grinding forces for all the wheels at similar feed rates. Feed rates were 0.8, 0.5, 0.2 microns/seconds. As seen from the above data, all of the new specifications exhibit lower grinding forces.

FIG. 3 compares the wear data for all the wheels. The wear/wafer can be calculated by the "m" value in the equation. (y=mx+c) where "m" is the slope.

TABLE III

| Specifications | "m" value wear in microns/wafer |
|---|---|
| Dual 2 | 0.03 |
| Dual 5 | 0.23 |
| Dual 3 | 0.35 |
| STD BXL6550 (Prior Art) | 0.79 |

The "m" value for all the specifications with physical blowing agent was lower than the "prior art" wheel. By using wheels with physical blowing agent, it expected that the wheels of the invention will exhibit higher life and will grind at lower forces.

Equivalents

While this invention has been particularly shown and described with reference to preferred embodiments thereof, it will be understood by those skilled in the art that various changes in form and details may be made therein without departing from the scope of the invention encompassed by the pending claims.

What is claimed is:

1. A superabrasive product, comprising:

a base having an axis of rotation and a raised perimeter;

an abrasive segment only on the raised perimeter, the abrasive segment comprising:

a) a superabrasive grain component; and b) a porous continuous phase that includes a thermoplastic polymer component having a blowing agent with an encapsulated gas wherein at least a substantial portion of the encapsulated gas is released, whereby the superabrasive product formed has a porosity that is substantially an open porosity, and wherein the superabrasive grain component is distributed in the porous continuous phase.

2. The superabrasive product of claim 1, wherein the porous continuous phase further includes a thermoset polymer component, and the blowing agent comprises expanded spheres.

3. The superabrasive product of claim 1, wherein the superabrasive is homogeneously distributed in the porous continuous phase and includes at least one member selected from the group consisting of diamond, cubic boron nitride, zirconia and aluminum oxide.

4. The superabrasive product of claim 3, wherein the thermoset polymer component includes at least one member selected from the group consisting phenol-formaldehyde, polyamide, polyimide and epoxy-modified phenol-formaldehyde.

5. The superabrasive product of claim 4, wherein the thermoset polymer component includes polyphenol-formaldehyde.

6. The superabrasive product of claim 3, wherein the superabrasive includes diamond.

7. The superabrasive product of claim 1, wherein the thermoplastic polymer component includes at least one member selected from the group consisting of polyacrylonitrile, polyvinyledene, polystyrene, nylon, polyethylene, polypropylene and polymethylmethacrylate.

8. The superabrasive product of claim 7, wherein the thermoplastic polymer component includes polyacrylonitrile.

9. The superabrasive product of claim 7, wherein the thermoplastic polymer includes polyvinyledene.

10. The superabrasive product of claim 9, wherein the polyvinyledene includes polyvinyledene chloride.

11. The superabrasive product of claim 7, wherein the thermoplastic polymer component includes polyacrylonitrile and polyvinyledene chloride.

12. The superabrasive product of claim 11, wherein the thermoset polymer component includes phenol-formaldehyde.

13. The superabrasive product of claim 12, wherein a ratio of the thermoplastic polymer component to the thermoset polymer component in the porous continuous phase is in a range of between about 80:15 and about 80:10 by volume.

14. The superabrasive product of claim 13, wherein a ratio of the porous continuous phase to the superabrasive grain component is in a range of between about 2:1 and about 1:2 by volume.

15. The superabrasive product of claim 14, wherein the superabrasive grain component has a number average particle size in a range of between about 0.25 μm and about 30 μm.

16. The superabrasive product of claim 15, wherein the superabrasive grain component has a number average particle size in a range of between about 0.5 μm and about 1.0 μm.

17. The superabrasive product of claim 15, wherein the superabrasive grain component has a number average particle size in a range of between about 3 μm and about 6 μm.

18. The superabrasive product of claim 15, wherein the superabrasive grain component has a number average particle size in a range of between about 20 μm and about 25 μm.

19. The superabrasive product of claim 11, wherein the superabrasive product has a porosity in a range of between about 30% and about 80% by volume.

20. The superabrasive product of claim 11, wherein a ratio of polyacrylonitrile to polyvinyledene chloride is in a range of between about 1:1 and about 98:2 by weight.

* * * * *

UNITED STATES PATENT AND TRADEMARK OFFICE

CERTIFICATE OF CORRECTION

PATENT NO. : 8,216,325 B2
APPLICATION NO. : 12/387792
DATED : July 10, 2012
INVENTOR(S) : Rachana D. Upadhyay It is certified that error appears in the above-identified patent and that said Letters Patent is hereby corrected as shown below:

In the Specification

Column 8, line 19, please delete "following Table 11" and insert therefor --following Table II--

In the Claims

Column 9, line 17, please delete "of claim 3" and insert therefor --of claim 2--

Column 10, line 6, please delete "of claim 11" and insert therefor --of claim 2--

Column 10, line 29, please delete "of claim 11" and insert therefor --of claim 15--

Signed and Sealed this
Twenty-sixth Day of August, 2014

Michelle K. Lee

Michelle K. Lee
*Deputy Director of the United States Patent and Trademark Office*